US007827961B2

(12) United States Patent
Cooke

(10) Patent No.: US 7,827,961 B2
(45) Date of Patent: Nov. 9, 2010

(54) FLUID PUMP

(75) Inventor: Michael Peter Cooke, Gillingham (GB)

(73) Assignee: Delphi Technologies Holding S.arl, Troy, MI (US)

( * ) Notice: Subject to any disclaimer, the term of this patent is extended or adjusted under 35 U.S.C. 154(b) by 80 days.

(21) Appl. No.: 12/291,014

(22) Filed: Nov. 5, 2008

(65) Prior Publication Data

US 2009/0126696 A1 May 21, 2009

(30) Foreign Application Priority Data

Nov. 5, 2007 (EP) ..... 07254364

(51) Int. Cl.
*F02M 57/02* (2006.01)
*F04B 49/00* (2006.01)

(52) U.S. Cl. ..... 123/446; 417/215; 417/429

(58) Field of Classification Search ..... 123/445, 123/446, 447, 495; 417/53, 214, 215, 216, 417/429, 470, 471, 294, 298, 441
See application file for complete search history.

(56) References Cited

U.S. PATENT DOCUMENTS

| | | | | |
|---|---|---|---|---|
| 2,497,300 | A | 2/1950 | Elliott | |
| 3,215,080 | A | 11/1965 | Bernard | |
| 4,235,374 | A * | 11/1980 | Walter et al. | 239/90 |
| 4,422,424 | A * | 12/1983 | Luscomb | 123/447 |
| 4,593,664 | A * | 6/1986 | Omori et al. | 123/446 |
| 4,951,631 | A * | 8/1990 | Eckert | 123/446 |
| 4,976,244 | A * | 12/1990 | Eckert | 123/501 |
| 5,040,511 | A * | 8/1991 | Eckert | 123/446 |
| 5,322,418 | A * | 6/1994 | Comer | 417/53 |
| 5,377,636 | A * | 1/1995 | Rix et al. | 123/446 |
| 5,460,133 | A * | 10/1995 | Perr et al. | 123/446 |
| 5,611,317 | A * | 3/1997 | Peters et al. | 123/501 |
| 5,876,189 | A * | 3/1999 | Lukas et al. | 417/392 |
| 6,267,086 | B1 * | 7/2001 | Dingle et al. | 123/25 R |

FOREIGN PATENT DOCUMENTS

| | | |
|---|---|---|
| DE | 41 00 832 | 7/1992 |
| DE | 195 16 686 | 11/1996 |
| EP | 1 022 458 | 7/2000 |
| GB | 276026 | 1/1928 |

OTHER PUBLICATIONS

European Search Report dated Mar. 26, 2008.

* cited by examiner

*Primary Examiner*—Thomas N Moulis
(74) *Attorney, Agent, or Firm*—Thomas N. Twomey

(57) ABSTRACT

A pump is provided for pumping two or more different fluids. The pump comprises a body having a longitudinal bore and at least first and second inlets selectively communicating with and providing passage to the bore via non-return valves. A plunger is mounted for reciprocation within the bore and at least one piston is also mounted for reciprocation within the bore so as to permit at least one type of fluid to pass into the bore through one or both inlets.

17 Claims, 5 Drawing Sheets

FLUID PUMP

FIELD OF THE INVENTION

This invention relates to pumps for fluids. More particularly, the invention relates to fuel pumps forming part of a fuel injection system. The invention extends to improved methods of pumping fluids.

DESCRIPTION OF THE PRIOR ART

Much recent research within the field of internal combustion engines has focussed on processes involving homogenous charge compression ignition (HCCI). However, it has been found that the known fuels used in such engines, i.e. petrol and diesel, do not permit engines to operate efficiently with such processes over the full ranges of load and speed typically encountered in vehicles.

A petrol engine typically operates using a spark to ignite pre-mixed fuel and air once it has entered an engine cylinder. The combustion reaction will initiate from the position of the charge spark and react with the fuel throughout the cylinder. In contrast, in diesel combustion, the air in a cylinder is compressed under the pressure of the piston, creating a hot, pressured environment. When the fuel is directly injected into the cylinder, the temperature and pressure of the air is sufficient to initiate combustion of the fuel, which spreads from the site of injection throughout the cylinder.

HCCI operates on the principle that a homogenous (pre-mixed) fuel/air mixture is introduced in the engine's cylinders and then compressed, the fuel igniting automatically when the appropriate conditions are reached within the cylinder, i.e. the temperature and pressure combination, sufficient for a combustion reaction to be initiated. At that moment, ignition occurs at multiple loci in the fuel, effecting simultaneous combustion throughout the cylinder. This clearly contrasts with the above-described spark-ignition and compression-ignition modes, in which there is always a boundary or point, from which combustion is initiated and, in which only a fraction of the fuel is therefore burning at any one particular time.

HCCI has a number of advantages, in particular: a superior fuel efficiency, due to virtually all of the fuel completing combustion; and reduced undesirable exhaust emissions as compared to the emissions from engines operating under conventional spark-ignition and compression-ignition modes.

However, the combustion of either petrol or diesel by the HCCI method currently has a number of limitations and/or disadvantages. For example, if the engine is operating at a relatively slow speed under a light load, such as at engine idle, the use of a mixture of diesel fuel and air is suitable because the conditions required for auto-ignition, at which virtually all the fuel will simultaneously ignite and combust, will occur at relatively low temperatures.

In contrast, if the engine is operating at a relatively fast speed and under a relatively heavy load, the temperature in the cylinders will be raised. This may cause the automatic ignition of diesel to occur too early in the compression phase of the piston movement cycle, i.e. before top-dead centre. This reduces the optimum efficiency (power output) of the engine. Further, the combustion rate of the diesel fuel will be high relative to that of conventional diesel engine. As a result, the pressure within the cylinder housing will dramatically increase, thereby imparting physical stresses and strains on the mechanical components actuating the piston.

Consequently, there is a significant risk that the internal engine will be damaged during use. A further disadvantage is that the engine will vibrate more readily, and hence will produce undesirable resonance during operation of the vehicle.

The use of a petrol-air mix in an HCCI system when the cylinders operate at a high speed is advantageous, since the temperature required to initiate auto-ignition is greater than that for a diesel-air mix. The rate of combustion is not significantly different from that experienced in a conventional petrol charge spark system, and hence no undesirable pressure is produced within the cylinders. However, it follows that, under low speed operation, it is difficult to achieve auto-combustion of petrol through compression of the fuel alone.

Since neither petrol nor diesel fuel is ideal for use in HCCI systems in an engine that operates over a full range of speeds and loads, it has not been possible to apply this mode of ignition successfully to a conventional vehicle engine. A system, in which an engine would be able to make use of a plurality of fuel streams and/or fuel mixtures offering flexibility in combustion characteristics for various modes of operation, would be desirable. However, such a system has not been designed without suffering substantial additional problems.

For example, it is known to provide a system, wherein two different fuels are used, so as to address some of the aforementioned problems. However, it would be expensive to provide two separate pumps to supply two different fuels, since high-pressure pumps are expensive to manufacture. A single high-pressure pump incorporating separate pumping elements for each type of fuel has also been considered. However, such an arrangement would not be ideal due to the inefficiency and weight associated with the necessary design: the required capacity of the pump would be twice the volume of fuel it can actually pump at any one time.

The invention arises from the Inventor's efforts to provide a technology that implements HCCI in a conventional vehicle without suffering from the above-mentioned problems and that is compatible with other technology currently used for common-rail fuel injectors.

SUMMARY OF THE INVENTION

In accordance with a first aspect of the invention there is provided a pump for pumping a fluid, the pump comprising: a body defining a longitudinal bore; first and second inlets communicating with the bore; first and second outlets communicating with the bore; a plunger slidably mounted for reciprocation within the bore so as to pump fluid from the first inlet to the first outlet and from the second inlet to the second outlet; a piston slidably mounted within the bore and arranged to operate in a first, stationary mode, wherein fluid may be pumped from the second inlet to the second outlet by the reciprocation of the plunger alone, and in a second, reciprocating mode, wherein fluid may be pumped from the first inlet to the first outlet by the reciprocation of both the plunger and the piston. The pump comprises a retainer for selectively holding the piston in a first stationary position.

The pump is able to operate so that a plurality, e.g., two, fuel streams of differing combustion/ignition characteristics can be pumped/injected at different times—without the fluids becoming mixed or cross-contaminated within the pump. This can be achieved by providing a piston, within the bore of the pump, that effectively divides the space within the bore and selectively pumps fluid from first and second inlets. The piston is arranged to move along the longitudinal bore to allow at least one fluid having a first set of properties to pass through the pump from the first inlet or second inlet into the bore at any one time. The position of the piston is dependent on the fluid pressure at the inlets.

Usefully, since these components are integrated within a single pump, selectively pumping of at least two fluids having one or more differing properties is possible—without requiring a system that occupies an unacceptably high volume.

Furthermore, by arranging for the piston to be movable within the bore and enabling more than one fluid to be pumped, regardless which inlet is activated, this gives rise to a relatively low dead volume of fluid within the pump. Each of the inlets may be provided with a respective one-way valve to prevent back-flow of the fluid from the bore into the inlets.

The retainer attracts or temporarily holds the piston to the ceiling of the bore; for example, an electromagnet positioned within the housing and energized as required. The piston can be held in this position to block the first inlet, so as to disable the filling of fluid through the first inlet during at least a first part of the filling stroke in the pumping cycle. Advantageously, a reduced dead volume is observed in the bore when fluid is pumped, enabling the pump to work more efficiently.

This effect above is further enhanced if the first inlet communicates with the bore directly through the closed end of the bore. In this instance the electromagnet can itself act to block the inlet.

In one embodiment, the end of the plunger, which abuts the piston, is profiled in such a way as to create a space within the bore—between the plunger and the piston. Specifically, the plunger may have an upper portion having an outer surface that is recessed relative to that of the remainder of the plunger. The space is defined between the recessed surface of the plunger and the facing inner surface of the bore.

The longitudinal bore has a closed end that limits the movement of the piston within the body of the pump.

In one embodiment, the first inlet communicates with the bore proximal to the closed end. In one variant, the first inlet is within the closed end itself. As the piston moves down the bore away from the closed end, fluid is drawn through the first inlet, filling the space above the piston. During this process, the one-way valve in the first inlet is retained in its open position by the pressure of the fluid supplied to the first inlet. The plunger then pushes the piston back up the bore towards its closed end. The resulting pressure difference between the bore and the first inlet causes the one-way valve in the first inlet to close, forcing the fluid to pass into the outlet via the one-way outlet valve, which is caused to open by the increased pressure within the bore. Advantageously, only a negligible quantity of the fluid is retained within the bore during each complete pumping cycle and therefore the volumetric efficiency of the pump is extremely high.

When the pressure of a second fluid supplied to the second inlet exceeds that of the first fluid, this causes the piston to remain in contact with the closed end of the bore, even when the plunger is moved in the direction away from the closed end during a filling stroke of its pumping cycle. Fluid is therefore drawn into the bore from the second inlet and fills the space between the ends of the piston and the plunger.

Furthermore, the second inlet may connect with the bore at a distance from the closed end of the bore that is greater than, or preferably, approximately equal to, the length of the piston. Advantageously, when the plunger moves in the direction towards the closed end of the bore on the pumping stroke it abuts the bottom surface of the piston and forces the fluid through the outlet, leaving only a small quantity of fluid remaining within the bore. This gives rise to an extremely high volumetric efficiency of the pump.

It is desirable that two or more fluids can be pumped simultaneously. This is particularly useful when both fluids are required to be used at the same time, for example, when pumping fluids for dual fuel injection.

In one embodiment, this is achieved by supplying both fluids at substantially the same pressure, thus causing the two respective one-way valves in the first and second inlets to be opened simultaneously. Preferably the end of the piston is tapered so as not to block the second inlet when the piston moves outwardly from the bore. Specifically, the piston may have a bottom portion having an outer surface that is recessed relative to an outer surface of the rest of the piston. It is possible that the recess may additionally or alternatively be in the plunger and/or the inner surface of the bore to provide this function or enhance the effect. Two different fluids are drawn from each inlet into separate regions within the bore. The pump preferably comprises at least two outlets, corresponding with the first and second inlets on the opposing bore surface, so each fluid is passed through the pump independently of the other with substantially no mixing.

Further still, the pump may comprise a member for limiting the movement of the piston in the bore such that it is prevented from moving into a position, in which it would disable the second inlet. This feature may be present with or without the piston being tapered. Preferably, the restricting member comprises at least one stop or flange, and this may be located on the inner surface of the bore approximately level with one side of the second inlet.

Usefully, in response to the outward movement of the plunger, the piston moves away from the closed end of the bore, creating a space near the first inlet. However, the piston then abuts the stop or flange, thereby preventing the piston from closing off the second inlet.

Although the tapered portion of the piston moves close to the second inlet, a space in the bore is still present between the second inlet and the tapered portion of the piston. Different fluids may therefore be drawn simultaneously into separate spaces within the bore on the filling stoke of the pumping cycle and pumped out through respective outlets on the pumping stroke. It is therefore desirable to have at least two outlets in the housing communicating with the bore and providing passages therefrom. Advantageously, when the piston is pumping in this arrangement, the pressure in the separate spaces will be substantially the same, minimising the risk that fluid from one space will leak into the other space.

This arrangement is particularly useful when fluid entering from the first inlet has a relatively low viscosity at increased temperatures, e.g. petrol, ethanol or dimethylether (DME). Such fluid would normally be unsuitable for a pumping system that experiences relatively high pressure, as it is difficult to seal within a distinct space in the pump.

Advantageously, the pressures above and below the piston may be equalised during pumping. This may be in the form of a pressure seal. Preferably, the pressure seal is located on the piston, contacting the inner surface of the bore. Such an arrangement provides that fluids either side of the piston to remain separated and moderately pressurised. This is particularly useful as fluids such as DME must be held under pressure to prevent them from evaporating. The above embodiment allows these types of fluids to be used. As a further benefit, the spaces within the pump remain pressurised even when the pump is not activated, so the pump does not require additional purging systems.

The pump may additionally comprise a sensor for sensing when the piston is at the closed end of the bore. The sensor can be located directly within the bore of the pump. Such a sensor is able to supply information relating to the timing, at which the piston reaches the top of its stroke, and the information can be supplied to an engine management system. This information can, in turn, be used to enhance further the pumping mechanism.

It may be desirable to fill the pump with two different fluids but to pump out only a single fluid from the bore into an outlet. For example, a first fluid may be usefully present in the bore to act as a buffer allowing a fuel, having relatively low lubricity as compared to the first fluid, to be pumped through. In such an embodiment the pump housing need comprise a only single outlet opposing the first inlet.

The invention is not limited to arrangements for pumping only a single fluid or two fluids, and one skilled in the art will appreciate that the pump may comprise further inlets and outlets, through which additional fluids can be pumped. Such an arrangement may comprise one or more additional pistons and actuation systems to keep the respective fluids separated from one another. For example, a three-fluid system could include oil, diesel and petrol.

The fluids that are pumped through the first and second inlets into the respective regions within the bore may be two different types of fuel. However, other non-fuel fluids could alternatively be used, either alone or in combination with one or more types of fuel. For example, water or urea solution could be used in the first inlet and lubricating oil in the second inlet.

In a second aspect the invention provides a pump for pumping a fluid, the pump comprising a body defining a longitudinal bore, first and second inlets communicating with the bore, a first outlet communicating with the bore, a plunger slidably mounted for reciprocation within the bore so as to pump fluid from the first inlet to the first outlet; and a piston slidably mounted within the bore and arranged to operate in a first, stationary mode, in which fluid may be pumped from the second inlet to the second outlet by the reciprocation of the plunger alone, and in a second, reciprocating mode, in which fluid may be pumped from the first inlet to the first outlet by the reciprocation of both the plunger and the piston.

In a third aspect of the invention a pump is provided for pumping a fluid, the pump comprising a body defining a longitudinal bore, first and second inlets communicating with the bore, a first outlet communicating with the bore, a plunger having an upper portion with a recessed outer surface relative to the rest of the plunger, slidably mounted for reciprocation within the bore so as to pump fluid from the first inlet to the first outlet, a piston slidably mounted within the bore and arranged, such that, in use, the plunger and the piston in combination define first and second chambers within the bore, the first chamber communicating with the first inlet and the first outlet, and the second chamber communicating with the second inlet, wherein when the plunger abuts the piston, a space in the bore is defined by the recessed outer surface of the plunger and an inner facing surface of the bore.

The invention extends to a fuel injection system incorporating a pump of the type described above and also to an internal combustion engine having such a fuel injection system.

The invention has particular application to a fuel injector, when different fuels are required to be pumped to an internal combustion engine. The invention therefore extends to a fuel injector having a pump as previously described and to an internal combustion engine comprising such a fuel injector.

One skilled in the art will appreciate that heavy fuel in the form of oil or bitumen or even solids could be utilised as fluids to be pumped within a fuel injection system in an internal combustion system, provided that, once the engine has started and a sufficient internal temperature attained, the solids melt and may be pumped in the above-described way.

The invention further extends to a method for pumping two different fluids independently using a single pump, the pump comprising a plunger arranged for reciprocal movement within a longitudinal bore and a piston that cooperates with the plunger, a first inlet arranged to be selectively in communication with a first outlet via a first region within the bore and a second inlet arranged to be selectively in communication with a second outlet via a second region of the bore, in dependence on the position of the piston within the bore, the method comprising: supplying a first fluid to the first inlet; supplying a second fluid to the second inlet; and controlling the position of the piston within the bore to allow the first fluid to be pumped from the first inlet to the first outlet and/or the second fluid to be pumped from the second inlet to the second outlet.

It is asserted by the applicants that individual features of any of the specific embodiments of the invention may be applied to other embodiments singularly or in combination with one another. For example, the stop feature and/or annular seal may be applied to any embodiment, with any combination of other features hereinbefore described.

BRIEF DESCRIPTION OF THE DRAWINGS

In order that the invention may be more readily understood, preferred non-limiting embodiments thereof will now be described with reference to the accompanying drawings, in which.

DETAILED DESCRIPTION OF THE PREFERRED EMBODIMENTS

Figure 1:
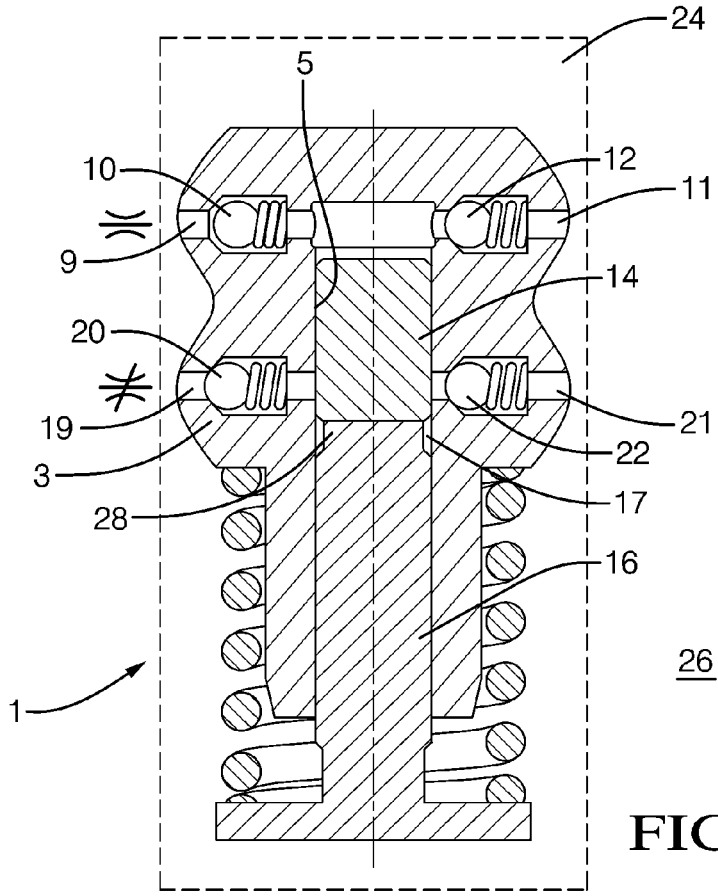
FIG. 1 is a cross-sectional view of a pump according to one embodiment of the invention, shown at the filling stage within the pumping cycle, during which a first fluid passes into the bore through the first inlet.
Figure 2:
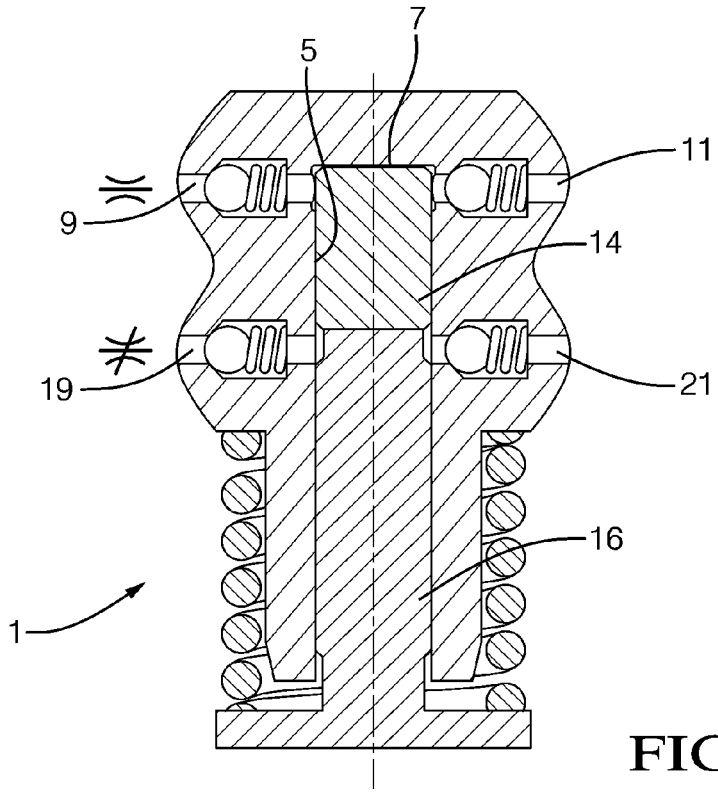
FIG. 2 is a cross-sectional view of the pump of FIG. 1, shown at the end of the pumping stage, at which the first fluid has passed from the bore into the first outlet.

FIGS. 1 and 2 show a pump 1 comprising a housing 3 having a central bore 5 extending inwardly therein. The pump 1 further comprises an independent cylindrical piston 14 that is positioned within the bore 5 towards its blind end. A longitudinal plunger 16, partially housed within the bore 5, traps the piston 14 within the bore 5 and restricts the longitudinal movement of the piston 14 therein. The plunger 16 comprises a recessed portion 28 that has an upper surface that contacts a lower surface of piston 14. The surface of the recessed portion 28 and the inner surface of the relative part of the bore together define an annular space 17. The motion of the plunger 16 is controlled by actuating mechanism (not shown) (e.g. cam and roller, crank, eccentric, inclined plane, solenoid and piezoelectric stack etc). The actuating mechanism repeatedly moves the plunger 16 through the filling and pumping strokes of the pumping cycle. The pump 1 may be included as part of a fuel injector 24 of an internal combustion engine 26 in the same way a prior art pump is known to be included in a fuel injector of an internal combustion engine.

The blind end defines a ceiling 7 of the bore. A first inlet 9 comprises a passageway that communicates with the bore 5 proximal to its ceiling 7. A first one-way valve 10 is arranged to open or close the first inlet 9 in dependence on the pressure difference across the valve 10. A first outlet 11 comprises a passage that communicates with the bore 5 proximal to its ceiling 7. A second one-way valve 12 is arranged to open or close the first outlet 11 in response to the pressure difference across the valve 12. A second inlet 19 comprises a passageway that communicates with bore 5. A third one-way valve 20 is arranged to open or close the second inlet 19, again in dependence on the pressure difference across the valve 20. A second outlet 21 comprises a passage that communicates with the bore 5. A further one-way valve 22 is adapted to open or close outlet 21.

Referring specifically to FIG. 1, the pump 1 is shown during in the filling stroke of a pumping cycle. If the first fluid is required to be pumped, this fluid is pressurised so as to cause the first one-way valve 10 to open. When the plunger 16 is retracted from the bore 5 by the actuating mechanism, the lower surface of the piston 14 is held firmly against the upper surface of the recessed portion of the plunger 16. The outward movement of the piston 14 and plunger 16 create a vacuum within the bore 5, and the first fluid is drawn through inlet 9 into the bore 5, at least partially filling the space in the bore 5.

In FIG. 2, the plunger 16 is shown during the uppermost position of its stroke of the pumping cycle. The piston 14 has been moved by the plunger 16 back into the bore 5 until the upper surface of the piston 5 is in contact with the ceiling 7 of the bore 5, which has caused the first fluid to be forced out of the bore 5 and into the first outlet 11 and out of the pump 1.

Figure 3:
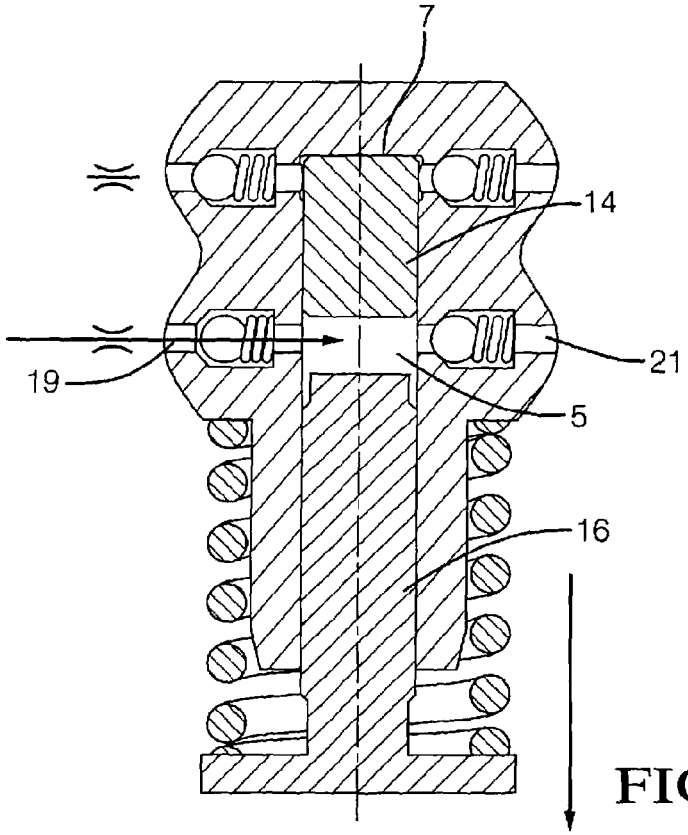
FIG. 3 is a cross-sectional view of the pump of FIG. 1, in a further mode of operation shown at the filling stage, during which the second fluid passes into the bore through the second inlet.

Referring now to FIG. 3, there is shown a pump 1 in the filing stroke of the pump cycle when the first inlet 9 is closed and the second inlet 19 is opened. As the plunger 16 is retracted from the bore 5 a vacuum is created between the piston 14 and the plunger 16, and the second fluid from the second inlet 19 is drawn into the bore 5. In this case, the piston 14 is not held against the plunger 16 as the plunger is withdrawn from the bore 5. In this embodiment no fluid is permitted to flow through inlet 19 into the bore 5.

Figure 4:
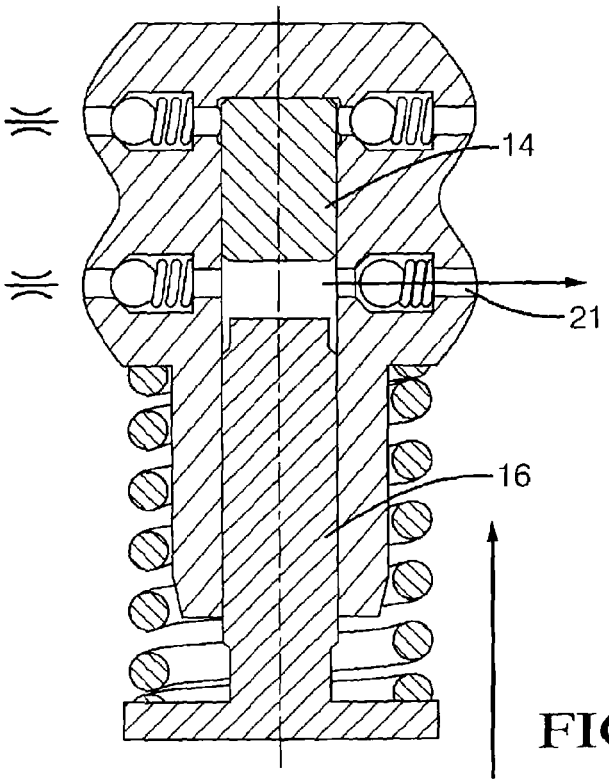
FIG. 4 is a cross-sectional view of the pump in FIG. 1, in the further mode of operation shown at the pumping stage, during which the second fluid passes from the bore into the second outlet.

As shown in FIG. 4, the plunger 16 is moved back into the bore 5 on the pumping stroke so as to reduce the volume of the space available for fluid within the bore 5. As the piston 14 moves inwardly, the fluid between the piston 14 and the plunger 16 is pressurised and thus pumped out of the bore 5 through the second outlet 21.

Figure 5:
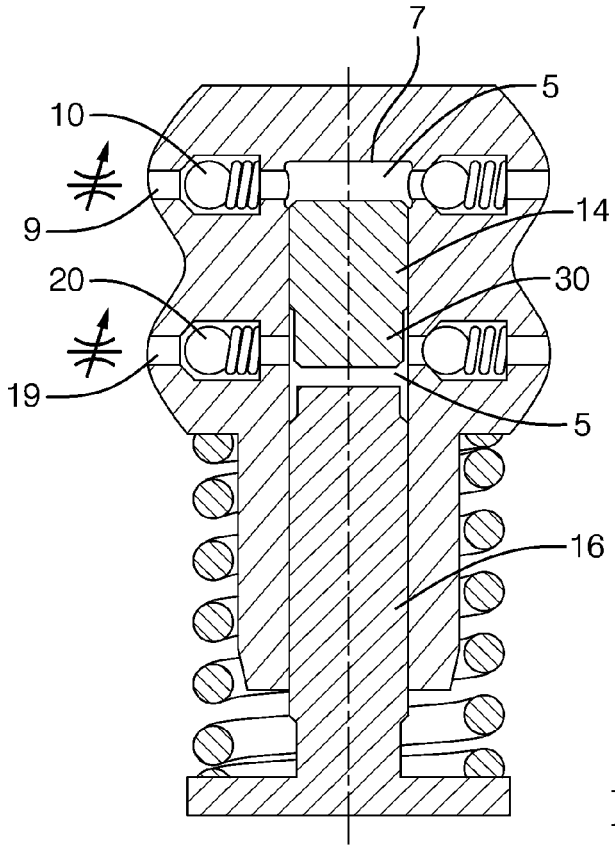
FIG. 5 is a cross-sectional view of a pump according to a further embodiment of the invention, wherein two fluids are simultaneously pumped.

FIG. 5 shows a further embodiment of a pump that operates such that two different fluids are pumped simultaneously. In this case both the first and second inlets 9, 19 are open, and their respective valves 10, 20 are therefore in the open state. As a result, the piston 14 is not retained in contact with the plunger 16, and when the plunger 16 begins to retract from the bore 5, during the pump's filing stroke, a vacuum is created in the bore both (a) between the piston 14 and the plunger 16 and (b) between the piston 14 and the ceiling 7 of the bore. The piston 14 in this embodiment has a tapered portion 30, thereby preventing the body of the piston 14 from blocking the second inlet 19 when the piston 14 is moved outwardly from the bore 5. In addition, the piston 14 is of acceptable size, or rather the inlet passages 9, 19 are at a sufficient distance from one another, such that, when the plunger 16 moves, the piston 14 is positioned in the bore 5 at a position between the two inlets 9, 19, and fluid is drawn from each of the first and second inlets 9, 19 into the respective spaces created in the bore 5 above and beneath the piston 14. The pressure in these spaces will be substantially the same, so that the fluid from one space will be unlikely to leak into the other fluid-filled space. Two different fluids may therefore be drawn by one action into separate spaces in the bore 5 of the pump 1 and then pumped out simultaneously through respective outlets 11, 21.

Figure 6:
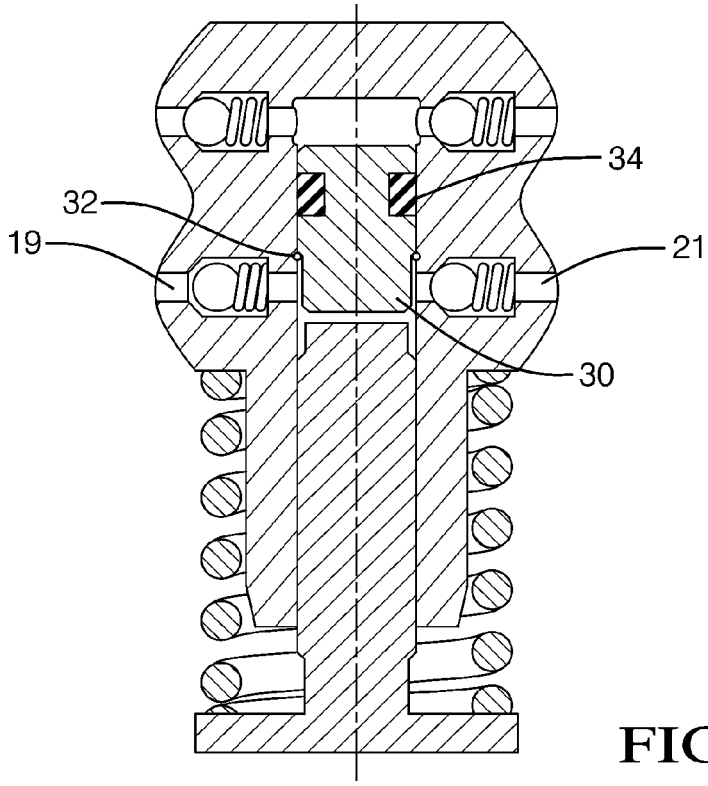
FIG. 6 is a cross-sectional view of a pump of another embodiment of the invention, wherein the pump further includes and end-stop and a sealing arrangement.

FIG. 6 shows a pump 1 in accordance with a further embodiment, having a number of additional features. A stop member 32 in the form of an annular projection within the bore 5 is located at a longitudinal position approximately level with the top of the second inlet 19 and the second outlet 21. When the piston 14 moves outwardly from the bore 5, the stop member 32 abuts the main body of the piston 14, preventing the piston 14 from moving further. As a result, the piston 14 is prevented from covering the second inlet 19 and does not block the communication between inlet 19 and the bore 5. The tapered portion 30 of the piston 14, having a reduced diameter relative to the main body of the piston 14, is positioned in the bore 5 adjacent to the second inlet 19. However, a space in the bore 5 is still present between the second inlet 19 and the tapered portion 30 of the piston 5.

The pump 1 is also provided with an annular seal 34 located on the piston 14, which contacts the inner surface of the bore 5. The seal 34 prevents the fluid on one side thereof from mixing with, and thereby cross-contaminating, the fluid on the other side. The seal 34 also keeps at least the fluid in the closed end of the bore moderately pressurised within the pump 1 when it is switched off.

Figure 7:
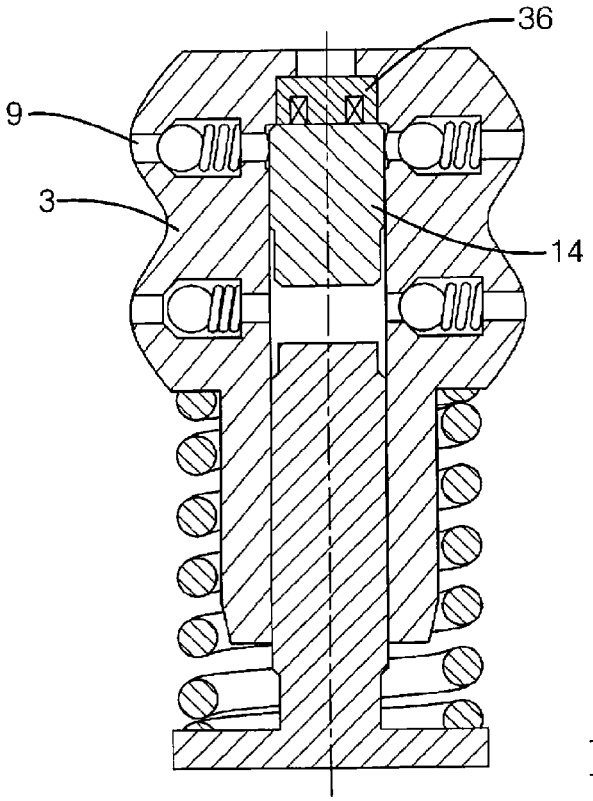
FIG. 7 is a cross-sectional view of a pump in another embodiment of the invention, which includes an electromagnet.

FIG. 7 shows an embodiment of the pump 1 having a device in the form of an electromagnet 36 positioned within the housing 3 of the pump 1 such that its lower surface is adjacent the ceiling 7 of the bore 5. If the first inlet 9 is required to be disabled, the electromagnet 36 is energised, and the piston 14 is thereby retained in position at the ceiling 7 of the bore 5. The piston 14 moves inwardly into the bore 5 until it contacts the ceiling 7 and is held there firmly. The piston 14 remains in contact with the ceiling 7 until the electromagnet 36 is de-energised.

Figure 8:
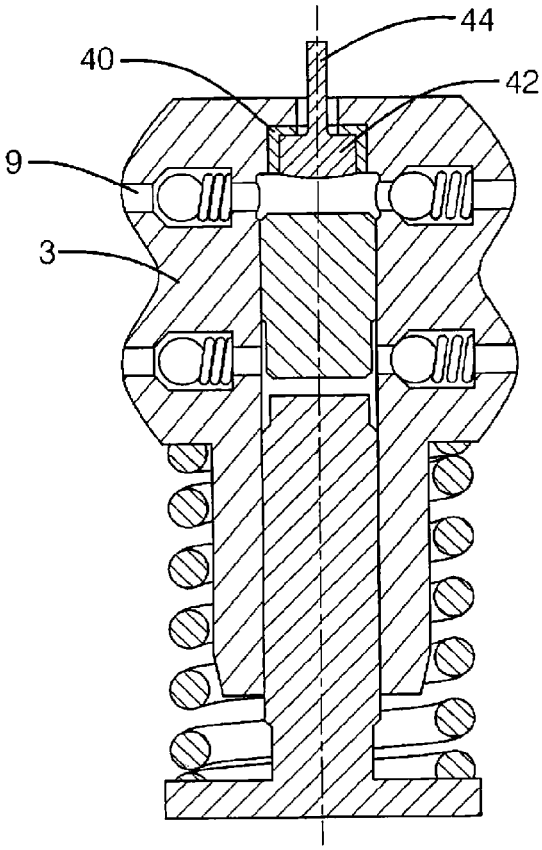
FIG. 8 is a cross-sectional view of a pump in another embodiment of the invention, further including a sensor.

An embodiment of the pump 1 having a sensor device 40 comprising a sensing surface 42 and a transmission lead 44, is shown in FIG. 8. The sensor device 40 is positioned within the housing facing the longitudinal bore 5. The sensing surface 42 itself defines a ceiling of the bore 5. The sensory device 40 is arranged to detect the time, at which the piston 14 is at the ceiling of the bore 5. Information received by the sensory device 40 is passed to a central electronics unit (not shown) via the transmission lead 44.

Figure 9:
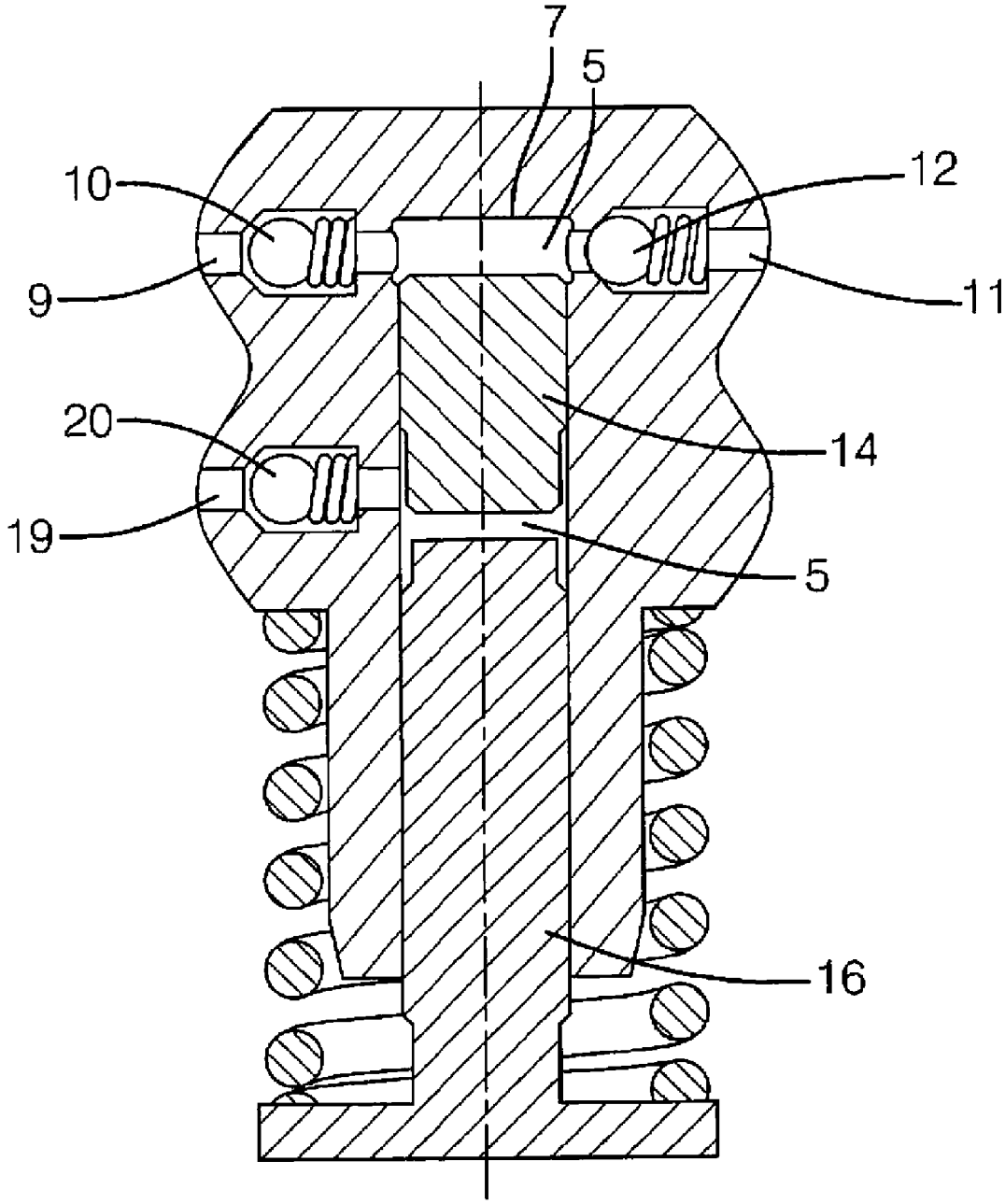
FIG. 9 is a cross-sectional view of a pump in another embodiment of the invention, further including a single outlet.

FIG. 9 shows a further embodiment of the pump 1 that comprises a single outlet 11 opposing the first inlet 9. A low-viscosity is injected through the second inlet 19 into the bore 5 between the piston 14 and the plunger 16. This creates a buffer that allows fuel having relatively low lubricity, as compared to the low-viscosity fluid, to be more easily pumped through the pump 1.

The invention claimed is:

1. A pump for pumping a fluid, the pump comprising:

a body defining a longitudinal bore;

first and second inlets communicating with the bore;

first and second outlets communicating with the bore;

a plunger slidably mounted for reciprocation within the bore and configured to pump, by reciprocation of the plunger, fluid from the first inlet to the first outlet and from the second inlet to the second outlet;

a piston slidably mounted within the bore and arranged to operate in a first, stationary mode, in which fluid may be pumped from the second inlet to the second outlet by the reciprocation of the plunger alone, and in a second, reciprocating mode, in which fluid may be pumped from the first inlet to the first outlet by the reciprocation of both the plunger and the piston; and a retainer for selectively holding the piston when in the first stationary mode.

2. A pump as claimed in claim 1, wherein the position of the piston is controlled by the fluid pressure at the first and second inlets.

3. A pump as claimed in claim 1, wherein each of the inlets and the outlets is provided with a respective one-way valve for preventing passage of the fluid from the bore into the first and second inlets and from each outlet into the bore.

4. A pump as claimed in claim 1, wherein the retainer comprises an electromagnet.

5. A pump as claimed in claim 1, further comprising a member for restricting movement of the piston within the bore such that the piston cannot prevent communication between the second inlet and the second outlet.

6. A pump as claimed in claim 5, wherein the member comprises an abutment.

7. A pump as claimed in claim 1, further comprising a sensor for sensing when the piston is in its first position.

8. A pump as claimed in claim 1, further comprising a device for selectively preventing the flow of fluid through one of the inlets.

9. A pump as claimed in claim 8, wherein the device comprises an electromagnet.

10. A pump as claimed in claim 1, wherein facing ends of the plunger and the piston are profiled to define an annular cavity within the bore.

11. A pump as claimed in claim 1, wherein the length of the piston is approximately equal to the longitudinal separation between the first and second inlets.

12. A pump as claimed in claim 1, further comprising a seal for preventing the mixing of fluids that have entered the bore through the first and second inlets.

13. A fuel injector comprising a pump as claimed in claim 1.

14. An internal combustion engine comprising a fuel injector as claimed in claim 13.

15. A method of pumping two different fluids independently using a pump as claimed in claim 1, the method comprising:

supplying a first fluid to the first inlet;

supplying a second fluid to the second inlet.

16. A pump for pumping a fluid, the pump comprising:

a body defining a longitudinal bore;

first and second inlets communicating with the bore;

a first outlet communicating with the bore;

a plunger slidably mounted for reciprocation within the bore so as to pump fluid from the first inlet to the first outlet; and a piston slidably mounted within the bore and arranged to operate in a first, stationary mode, in which fluid may be pumped from the second inlet to the second outlet by the reciprocation of the plunger alone, and in a second, reciprocating mode, in which fluid may be pumped from the first inlet to the first outlet by the reciprocation of both the plunger and the piston.

17. A pump for pumping a fluid, the pump comprising:

a body defining a longitudinal bore;

first and second inlets communicating with the bore;

a first outlet communicating with the bore;

a plunger having an upper portion with a recessed outer surface relative to the rest of the plunger, slidably mounted for reciprocation within the bore so as to pump fluid from the first inlet to the first outlet;

a piston slidably mounted within the bore and arranged, such that, in use, the plunger and the piston in combination define first and second chambers within the bore, the first chamber communicating with the first inlet and the first outlet, and the second chamber communicating with the second inlet; and wherein when the plunger abuts the piston, a space in the bore is defined by the recessed outer surface of the plunger and an inner facing surface of the bore.

* * * * *